US008644896B1

(12) United States Patent
Bock et al.

(10) Patent No.: US 8,644,896 B1
(45) Date of Patent: Feb. 4, 2014

(54) TUNABLE NOTCH FILTER INCLUDING RING RESONATORS HAVING A MEMS CAPACITOR AND AN ATTENUATOR

(75) Inventors: Daniel Mark Bock, Los Angeles, CA (US); Tomasz Jannson, Torrance, CA (US); Nathanael Keehoon Kim, Rancho Palos Verdes, CA (US); Alireza Shapoury, Rancho Palos Verdes, CA (US); Davis Tran, Fountain Valley, CA (US)

(73) Assignee: Physical Optics Corporation, Torrance, CA (US)

( * ) Notice: Subject to any disclaimer, the term of this patent is extended or adjusted under 35 U.S.C. 154(b) by 552 days.

(21) Appl. No.: 12/960,363

(22) Filed: Dec. 3, 2010

(51) Int. Cl.
*H01P 1/203* (2006.01)
*H01B 12/02* (2006.01)

(52) U.S. Cl.
USPC ..... 505/210; 333/99 S; 333/204

(58) Field of Classification Search
USPC ..... 333/99 S, 204, 219, 176; 505/210
See application file for complete search history.

(56) References Cited

U.S. PATENT DOCUMENTS 4,262,269 A * 4/1981 Griffin et al. ..... 333/204
5,328,893 A * 7/1994 Sun et al. ..... 505/210
5,616,539 A * 4/1997 Hey-Shipton et al. ..... 505/210
6,661,069 B1 12/2003 Chinthakindi et al.
7,692,516 B2 4/2010 Kim et al.
2002/0130734 A1 9/2002 Liang
2003/0222732 A1 12/2003 Matthaei

FOREIGN PATENT DOCUMENTS

WO 2004073100 A2 8/2004

OTHER PUBLICATIONS

Aurelie Cruau, V-shaped micromechanical tunable capacitors for RF applications,Microsystem Technologies Micro- and Nanosystems Information Storage and Processing Systems, Published online: Oct. 25, 2005.

* cited by examiner

*Primary Examiner* — Benny Lee
(74) *Attorney, Agent, or Firm* — Sheppard Mullin Richter & Hampton LLP

(57) ABSTRACT

A tunable notch filter, comprises a transmission line coupled to an antenna; a plurality of ring resonators inductively coupled to the transmission line, wherein each ring resonator of the plurality of ring resonators is grounded and comprises a variable microelectromechanical systems (MEMS) capacitor; wherein a set of variable MEMS capacitors of the plurality of variable MEMS capacitors are independently tunable to vary a notch location and a notch width of the tunable notch filter; and wherein a set of ring resonators of the plurality of ring resonators further comprises an attenuator configured to reduce power reflected from the antenna.

20 Claims, 8 Drawing Sheets

TUNABLE NOTCH FILTER INCLUDING RING RESONATORS HAVING A MEMS CAPACITOR AND AN ATTENUATOR

TECHNICAL FIELD

The present invention relates generally to passive analog filters, and more particularly, some embodiments relate to tunable notch filter systems for notch filtering high power jamming transmissions.

DESCRIPTION OF THE RELATED ART

Many communications systems utilize frequency hopping, a method of rapidly switching a carrier among many frequency channels, for a variety of purposes. For example, many military communications systems, such as HAVE QUICK, SINCGARS, Link-16, utilize frequency hopping to provide jamming resistance. In these systems, the carrier is rapidly switched between a set of frequency channels according to a pseudorandom sequence known to the transmitter and receiver.

Many miniature and tunable filters have been developed and used in consumer and military applications, including transmission line resonators with lumped elements, novel compact geometry resonators, dual-mode resonators, and new materials and artificial dielectrics. Tunable filters based on integrated lumped components generally suffer from a high insertion loss due to the low Q of conventional lumped components, such as metal-insulator-metal (MIM) and planar inductors. Semiconductor-based tunable filters show many advantages, but their insertion loss is still relatively high.

BRIEF SUMMARY OF EMBODIMENTS OF THE INVENTION

The present invention provides systems and methods for notching out RF power in a tunable frequency system from high power output (kW) wideband (VHF through L band) jammer systems to reduce or prevent interference within communication bands by the jamming system. The system is preferably able to reduce the power in defined bands, both statically and dynamically (frequency hopping), by a reduction of >30 dB in the desired band, with a speed of <1 μs, tunable to within 1 kHz, with notch widths from 15 kHz to 10 MHz. In addition, the capability to have a minimum of 8 bands is preferred to address normal operational requirements in the field of RF jamming and communication band frequency hopping.

In some embodiments, the resonating RF structure provides a very large tunable range by using voltage tunable capacitors to quickly (<1 microsecond) change the impedance to shift the notch filter location and width with minimal insertion loss (<0.5 dB). With voltage applied, the device can change the notch location within the 30 MHz to 4000 MHz range, and provide a notch width from 10 kHz to 8 MHz reflecting very little power to the source. With MEMS-type components, the systems can be fabricated in semiconductor batch processes and operate at ~77 K.

In some embodiments, a high power tunable notch filter is based on a superconducting varactor MEMS capacitor connected to a series of ring resonators as the primary filter element. Preferably, the filter can be configured to provide the capability to quickly (<1 μs) change the location and width of the notch band with ≥30 dB of loss within the notch band, with little reflected power back to the source due to the use of ring resonator filters, cost-effective manufacturability due to semiconductor batch processes, and a low-power cryogenic requirement due to the use of high-temperature superconductors. In some embodiments, the use of MEMS varactors provides the capability to tune the filter notches anywhere in the bands of interest and simultaneously choose the bandwidth with the array of them working in tandem. Further embodiments employ superconductors as the conductive elements, which increases the power handling capabilities because of their unique property to have almost no dissipation at RF frequencies, much lower than that of just cooled normal metals. In some embodiments, using yttrium barium copper oxide (YBCO) as the superconductor with a transition temperature near 92 K keeps the operating temperature near that of liquid nitrogen, simplifies operation use when compared to elemental superconductors that require temperatures near that of liquid He or H (between 4 and 20 K).

According to an embodiment of the invention, a tunable notch filter, comprises a transmission line coupled to an antenna; a plurality of ring resonators inductively coupled to the transmission line, wherein each ring resonator of the plurality of ring resonators is grounded and comprises a variable microelectromechanical systems (MEMS) capacitor; wherein a set of variable MEMS capacitors of the plurality of variable MEMS capacitors are independently tunable to vary a notch location and a notch width of the tunable notch filter; and wherein a set of ring resonators of the plurality of ring resonators further comprises an attenuator configured to reduce power reflected from the antenna.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a system and apparatus that provides a tunable notch filter. A plurality of ring resonators is inductively coupled to a transmission line, such as a RF stripline. The ring resonators are configured to be tunable by adjustment of variable capacitors (varactors) included in the resonators. In some embodiments, the ring resonators further include attenuating circuits to reduce reflected power.

In some embodiments, the entire filter scheme can be configured to have a small form factor of 4 cm×2 cm. Such a filter can have, for example, military and commercial applications, including its use in telecommunications for filter schemes such as installation into cell phone towers for fast and dynamic filtering of signals, satellite telecommunication platforms, commercial aircraft that require RF dynamic filters for improved performance and band switching, and any other device that requires or desires the capability to change RF filters during operations.

From time-to-time, the present invention is described herein in terms of various example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Figure 1:
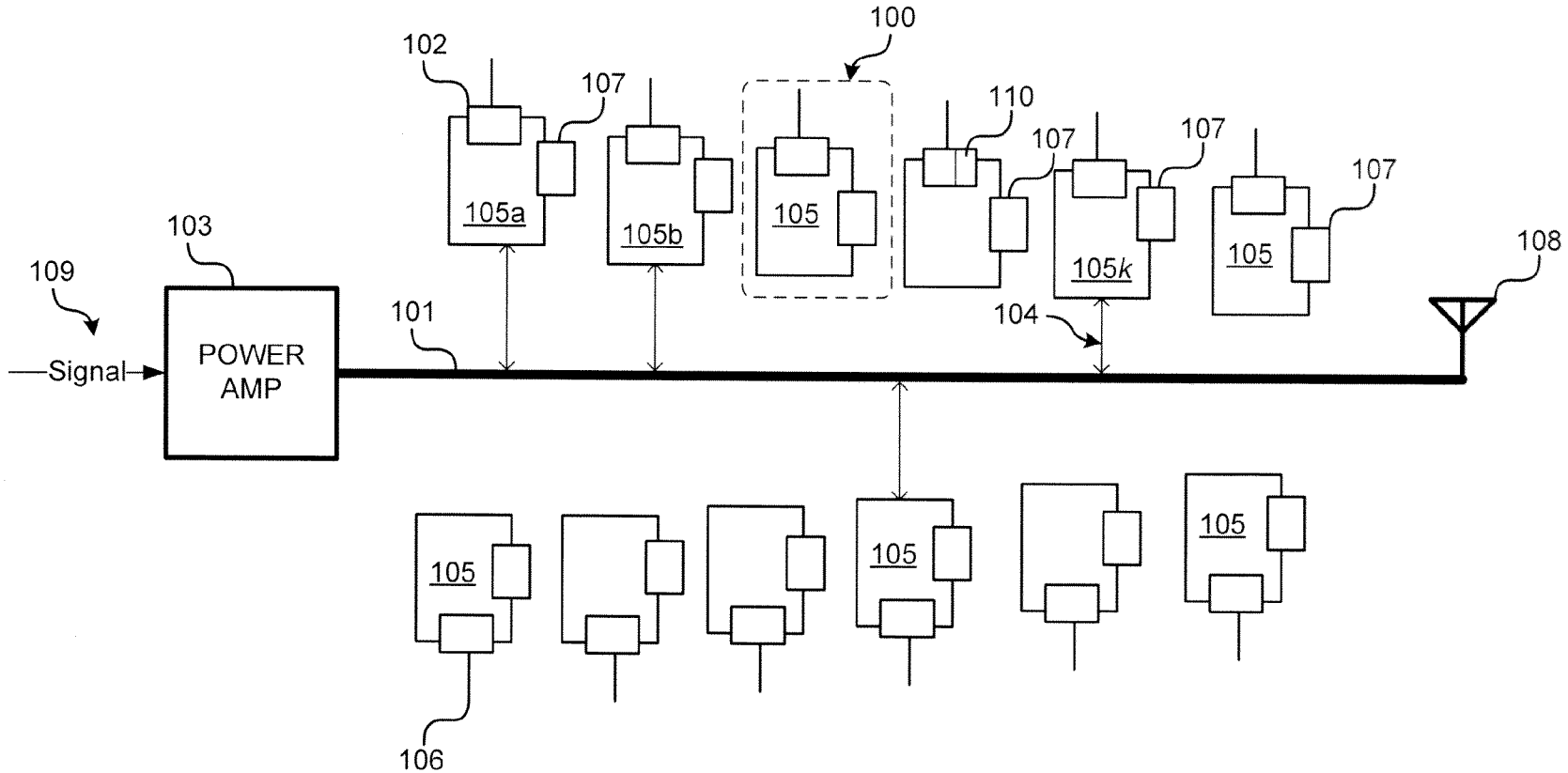
FIG. 1 illustrates a tunable notch filter implemented in accordance with an embodiment of the invention.

FIG. 1 illustrates a tunable notch filter implemented in accordance with an embodiment of the invention. The illustrated embodiment may be used in a wideband jamming system. A wideband jamming signal is transmitted to interfere with communications within range of the system. However, to allow communications by authorized parties, the power of certain frequencies are notched out during transmission. Through tunable filter elements, the frequencies are rapidly varied to allow for frequency hopping communications according to predetermined pseudorandom sequences. For example, some embodiments may be compatible with SINCGARS, HAVE QUICK, Link-16, Blue Force, or other communication systems that use frequency hopping.

In the illustrated embodiment, a signal 109, such as a high-powered jamming signal, is amplified by a power amplifier 103 and transmitted through a transmission line 101 to antenna 108. In some embodiments, the transmission line 101 comprises high power RF strip line, composed of a high-temperature superconductor, such as yttrium barium copper oxide (YBCO). In some embodiments, the use of superconductors keeps the insertion loss to a minimum (<0.5 dB) and allows the filter systems to operate at high power (~1 kW) without burning out the components. The power of particular frequencies is removed from the system by ring resonator notch filter elements 100. The illustrated embodiment has a tapped resonator architecture. Main power is transmitted almost loss-lessly through transmission line 101. Filter elements 100 act as band-stop filters that expunge notch spectrum of interest.

In the illustrated embodiment, a filter element 100 comprises a ring resonator 105, that includes a tunable capacitor 102 and an attenuator 107. In some embodiments, these filter elements 100 may be designed as tapped quarter-wavelength resonators. By adjusting a voltage bias on the tunable capacitor 102, the resonant frequency of the filter element 100 may be changed, thereby adjusting the notch filter frequency. In further embodiments, the element 100 further comprises a switch, such as a PIN diode 110, that allows activation and deactivation of the filter element. A drive and bias line 106 to a drive and bias bus allows a system control unit to control which filters 100 are active and the particular center frequencies of the various filters 105, such as 105*a*, 105*b*, . . . 105*k*. In some embodiments, the tunable capacitor 102 comprises a microelectromechanical system (MEMS)-based capacitor that is designed to meet the center frequency of the band-reject spectrum.

In some embodiments, some or all of the capacitors 103 are separately controllable. The capacitors are controlled by setting the voltages on the variable capacitors 102. Controlling the capacitors 102 allows each filter element 100 to be tuned to a different center frequency. This allows control over parameters such as notch location, number of notches, notch width, and filter order. For example, notch locations may be set by changing all of the variable capacitors 102 in a filter. In order to control the notch width, each ring resonator element 100 in the filter may be controlled slightly differently. Tuning them so that they do not have exactly the same impedance means the individual notches of each ring will not line up in the sub-band. This gives the filter the ability to set an arbitrary notch widths.

In other embodiments, the capacitors may be set to a static impedance value, to create a static filter element 100. For example, in some embodiments, the specific frequency sub-bands used in the relevant frequency hopping communication system may be known beforehand. In such an embodiment, each usable frequency sub-band may have a corresponding set of static filter elements 100. Switches coupled to the filter elements 100, such as diodes 110, may then be used to control the activation of the set of filters when the corresponding frequency sub-band is active. The number filters in each set may be determined according to various parameters, such as filter order and desired notch width and depth. In these embodiments, the switching structure is not in series with the transmission line. This may reduce switching deficiencies that often accompanies filter bank switching.

In the illustrated embodiment, the ring of the ring resonator has a rectangular shape, the rectangular shape provides linear boundary lines parallel to the main transmission, providing a larger contact area for interactions between the resonator 105 and transmission line 101. In further embodiments, other shapes, such as circular rings, can be used. In particular embodiments, the resonators, whether rectangular, circular, or some other shape, are made with a radial design, avoiding sharp corners. These embodiments have lower insertion loss and lower reflected power than other designs, such as hairpin designs. In a hairpin design, charge collection at sharp points cause fringe effects. Due to the large amount of charge collection, the impedance of the circuit increases and thus reduces performance. Therefore, by using a radial design (without sharp points), the performance is improved with lower insertion loss and lower reflected power with the filter design.

Filter elements 100 further comprise attenuator circuits 107. For example, an attenuator circuit 107 may comprise a plurality of resistor attenuators in a pi-pad attenuator structure coupled to the ring resonator 105 and to ground for RF matching. In some embodiments, the attenuators 107 coupled to ground reduce reflected power by sending power reflections to the ground instead of back to the source.

In some embodiments, the use of superconducting materials in transmission line 101 and ring resonators 105 reduces the insertion loss because of their very low AC resistance in frequencies below 10 GHz. The reflected power is also reduced by the use of resonating rings as opposed to other filter schemes that place components across the transmission line. Use of a varactor capacitor 102 provides the capability for dynamic notch filtering because of its large tuning range, compared to other MEMS devices with low control voltage. The filters can operate by the application of a biasing voltage that will change the impedance of the varactor, which in turn changes the resonances of the ring resonator. The power going down the transmission line that is then at the resonance will be shorted through the ring to ground, removing that frequency from the power spectrum being generated by the jamming system.

In embodiments utilizing superconducting materials, a cryogenic system is used to maintain the elements at the proper temperature. In one embodiment, The cryogenic system can be a liquid nitrogen type system. These can be used because they require a minimum of power to operate, liquid nitrogen is inexpensive, and the holding time for liquid nitrogen can be from days to weeks. It is also possible to use a closed circuit cryogenic system that will not need fresh liquid nitrogen injected into the cryostat on a regular basis. In a particular embodiment, a cryostat employed has a base temperature of about 77 K, a long holding time, RF feedthroughs, a vacuum chamber, and operates in a closed circuit system.

As further illustrated in FIG. 1, the filter elements 100 are disposed at distances 104 away from the transmission line 101. In some embodiments, the distances 104 of the various ring resonators 105 to the transmission line 101 may vary between the resonators. For example, resonator 105*a* might be disposed farther from the transmission line 101 than resonator 105*b*. Controlling the distance of the individual resonators to the transmission line controls the inductive coupling between the resonators and the transmission line. By adjusting the distances, so that some resonators are closer than others, the power can be balanced between the cascaded ring resonators in order to prevent damage to components when operating at 1 kW RF power.

Figure 2:
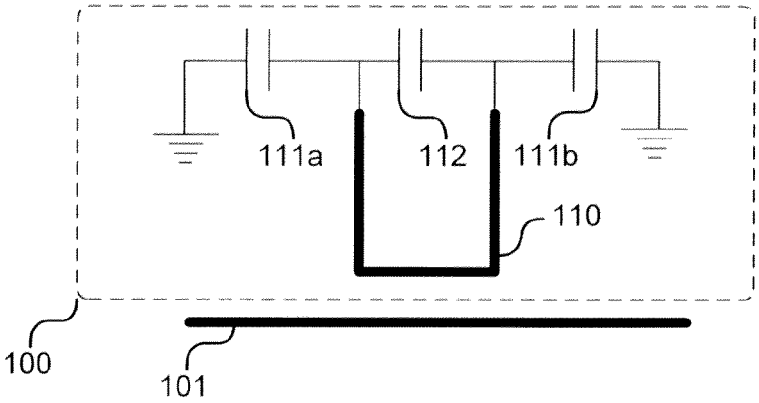
FIG. 2 illustrates the equivalent lumped circuit of a filter element implemented in accordance with an embodiment of the invention.

FIG. 2 illustrates the equivalent lumped circuit of a filter element implemented in accordance with an embodiment of the invention. The illustrated equivalent lumped circuit is of a filter element 100 that lacks an attenuating circuit. The stop-hand width δ with center frequency of $f_0$ can be obtained for each resonator connected to the line of impedance, according to the following equation:

$$\delta = Z_0 f_0 / 2\chi$$

where $\chi$ is a slope coefficient for a resonator that is a function of the fractional bandwidth (FBW), and $Z_0$ is the line of impedance. As $\chi$ is a highly nonlinear parameter, the physical geometry of the filter can be calculated more accurately by computer analysis software packages, such as Agilent's Advance Design (ADS), Ansoft, or AWS. In the illustrated equivalent circuit, the transmission line 101 is coupled to the conductive elements 110 of the resonator 100. The capacitance 111*a* ($C_1$) and 111*b* ($C_2$) is the shunt capacitance of the resonator 100, and the capacitance 112 ($C_3 = C_{MEMS} \| C_{PIN}$) is the equivalent capacitance of the MEMS device and PIN diode. For filter elements without a diode switch, the capacitance 112 is the capacitance of the MEMS device alone.

Figure 3:
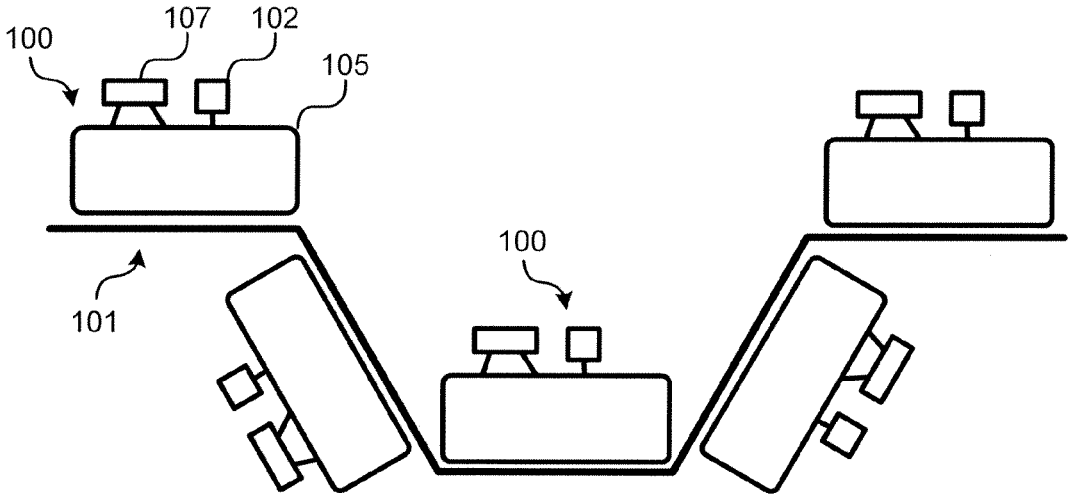
FIG. 3 illustrates a notch filter implemented in accordance with an embodiment of the invention.

FIG. 3 illustrates a notch filter implemented in accordance with an embodiment of the invention. In this embodiment, a filter element 100 comprises a band-stop filter inductively coupled to the transmission line 101 and implemented as a ring resonator 105. A attenuator 107 is configured to reduce reflected power, and may be configured as a resistor in a pi-pad configuration coupling the resonator to ground. A capacitor 102 sets the capacitance and, therefore, the resonant frequency of the filter element 101, based on the well-known relationship that the resonant frequency of a circuit is governed by the inductance and capacitance of the circuit. By setting the capacitor 102 of the filter elements 100, filter can be configured with a notch location and notch width. In a frequency hopping filtering system, multiple filters may be chained together and switchably activated and deactivated to follow the frequency hopping sequence.

Figure 4:
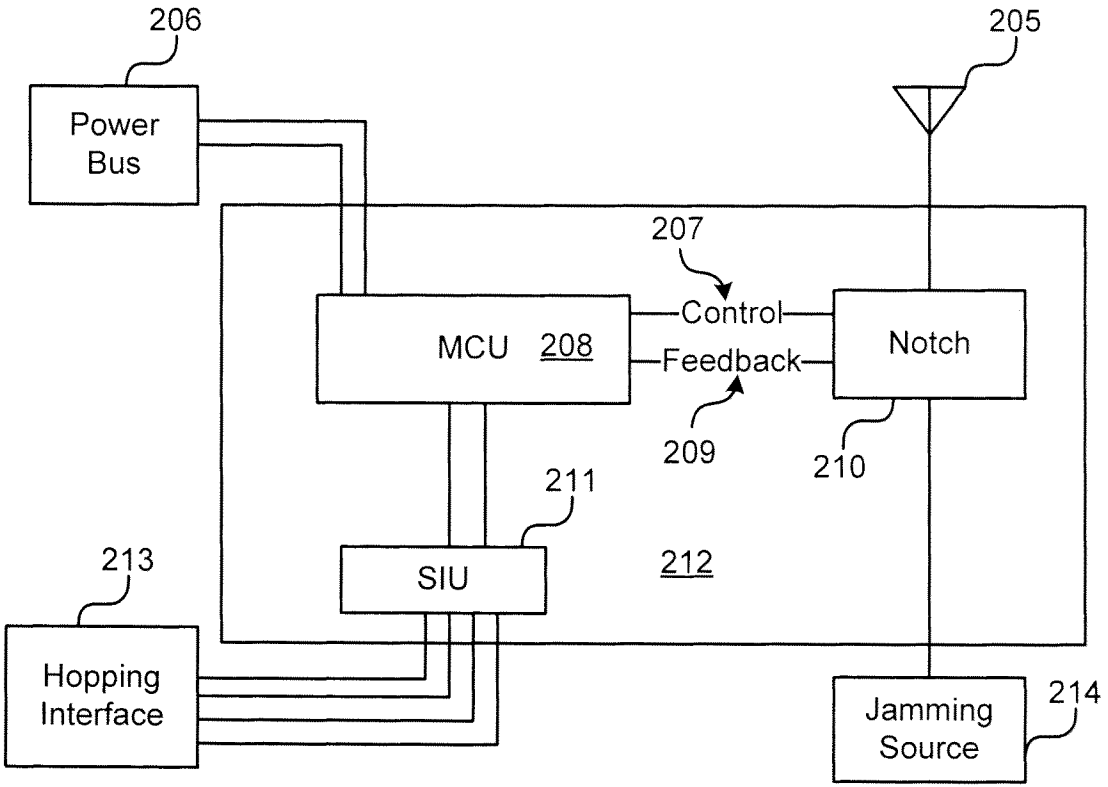
FIG. 4 illustrates a filter system implemented in accordance with an embodiment of the invention.

FIG. 4 illustrates a filter system implemented in accordance with an embodiment of the invention. The filter system 212 comprises a system interface unit (SIU) 211, a notch filter 210, and a control unit 208, such as a microcontroller unit (MCU). A power bus 206 is connected to the system and provides power to the various system components. A jamming signal source 214 provides a jamming signal for transmission to the antenna 205. The notch filter 210 filters out the required power in specific frequency bands in the jamming system in order to reduce interference with friendly communication. The control unit 208 is coupled to the notch filter 210 provides controls 207 to the notch filter 210 to control the parameters of the notch filter 210, such as the notch locations, widths, and speed of movement during use. The notch filter 210 may be further implemented with a feedback communications line 209 that allows the control unit 208 to monitor the notch location error. In one embodiment, the control unit 208 may be configured to adjust the notch location to keep the error below 0.001% at all times. In this embodiment, if the feedback circuit of the control unit 208 detects any system excursion beyond tolerances, it may signal a fault. System interface unit 211 may be coupled to a hopping interface 213 to allow the system interface unit 211 to receive hopping sequence information. In one embodiment, during operation, the system interface unit 211 will receive commands on where the notch needs to be located from the hopping interface 213. It will then give that information to the control unit 208, which then controls 207 the notch filter 210 components. In various embodiments, the filter system may be preconfigured according to a specific range for the filter. For example, the system may be configured to operate in a low-band (30-600 MHz) or mid-band (400-4000 MHz) range.

Figure 5:
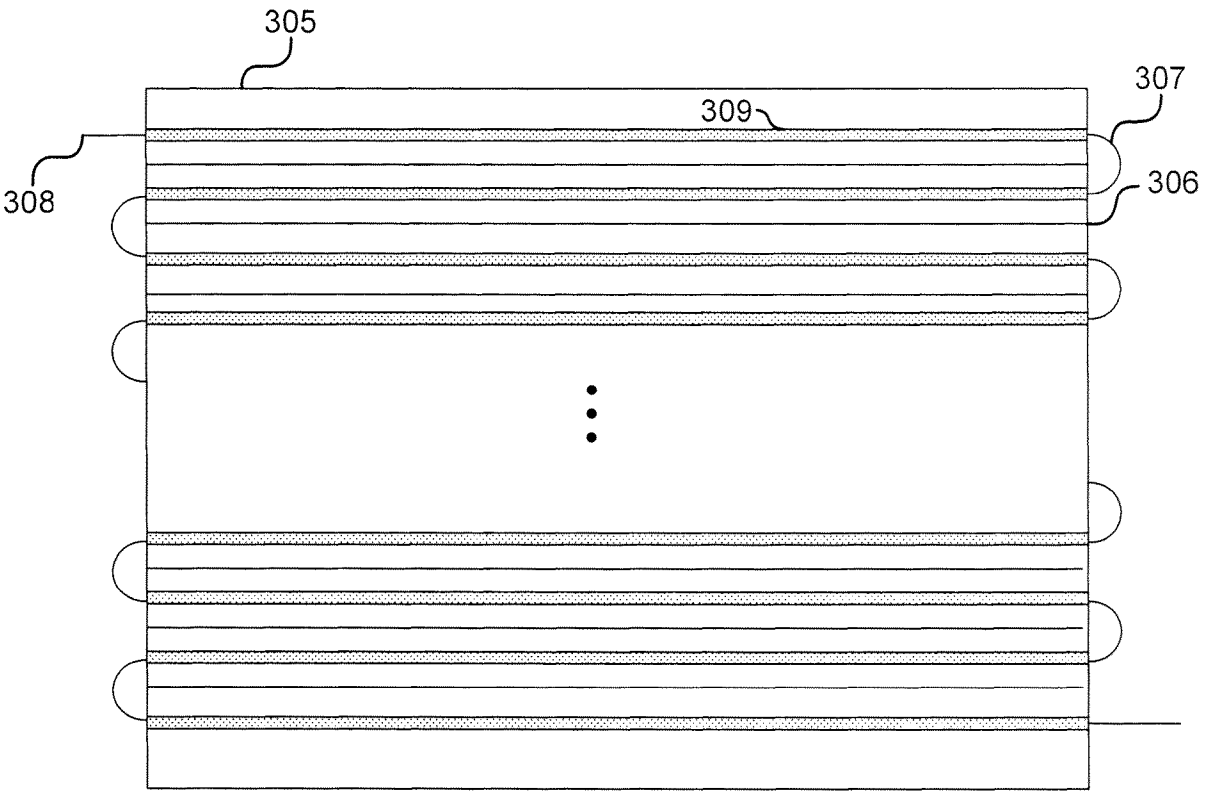
FIG. 5 illustrates a filter bank implemented in accordance with an embodiment of the invention.

FIG. 5 illustrates a filter bank implemented in accordance with an embodiment of the invention. In the illustrated embodiment, a plurality of filters 309 are installed in parallel inside a housing 305. For example, the filters 309 may be separately tuned static filters, as described with respect to FIG. 3, or may be independently tunable filters coupled to a control system. In some embodiments, the housing 305 may comprise an EMI shielding housing. In the illustrated embodiment, metal walls 306 are placed between filters 309 to separate the filters and reduce the electromagnetic fields generated by the filters 309. In a particular embodiment, each filter 309 has at least 35 dB isolation. The filters may be further equipped with wires for the DC voltage used to drive MEMS varactors. As discussed above, the filters 309 may comprise several boards with ring resonators along the transmission line 308 of each board. In further embodiments, each board may contain three high-Q transformers that act as a coupling line and are placed in series on the transmission line and ring resonators. In a particular embodiment, TNC connectors are used for the PCBs because of its ability to handle up to 2 kW of RF power and low-loss 50 Ohm cables 307 may be used to couple the filters 309 in series.

Figure 6:
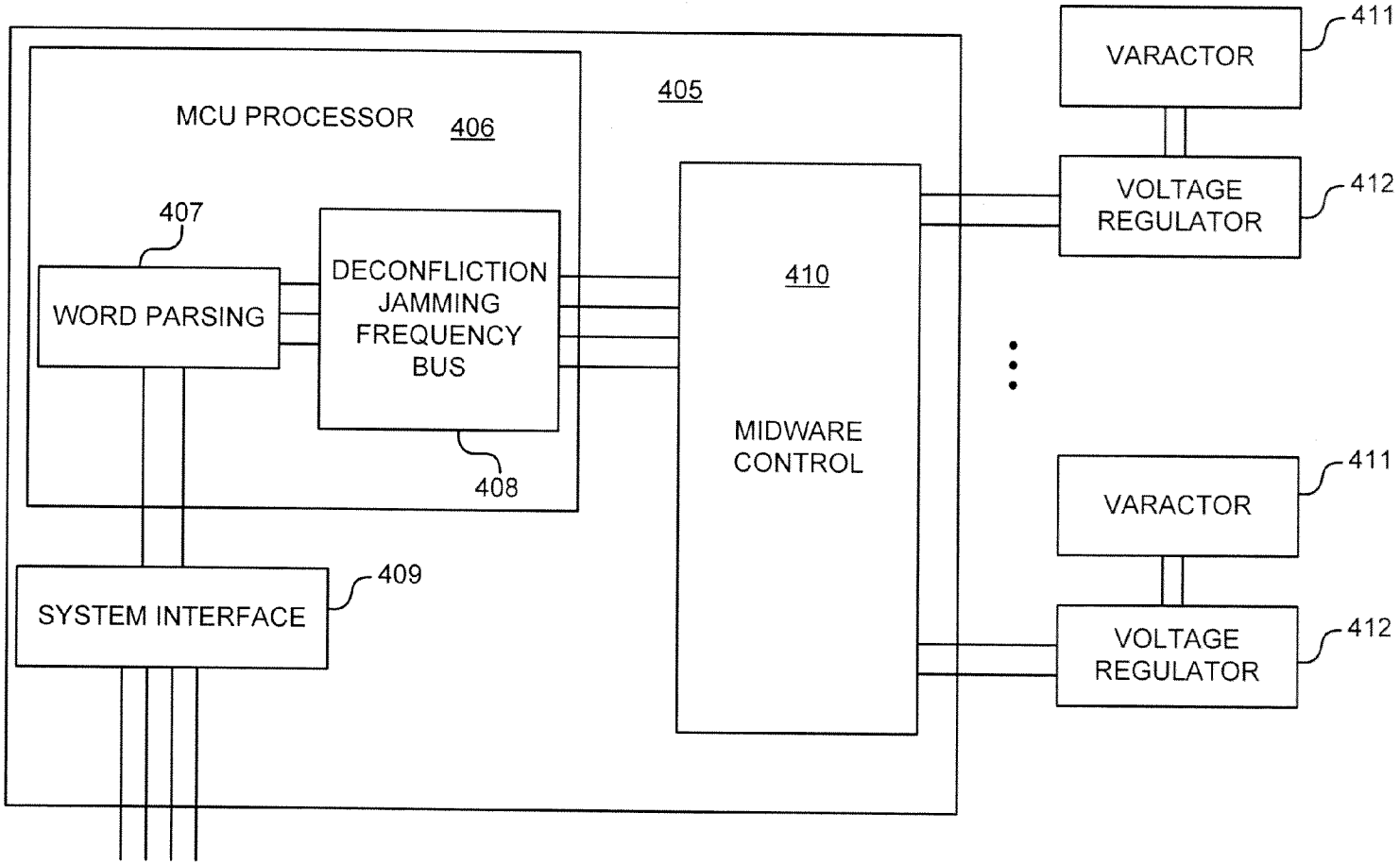
FIG. 6 illustrates a further filter system implemented in accordance with an embodiment of the invention.

FIG. 6 illustrates a further filter system implemented in accordance with an embodiment of the invention. In the illustrated embodiment, filter control unit 405 comprises a processor (MCU) 406, a midware control module 410, a system interface 409, a bus 408, and a word parsing module 407. A communication interface transmits commands for the current notch to the system interface 409. The data is then transmitted to the controller 406 for data handling in module 407. The deconfliction jamming frequency bus 408 in the processor 406 converts the information into the actual jamming notch locations and widths. This information is then sent to the midware control module 410 that decides which notches will be controlled. The midware control module 410 then transmits the control information to the voltage regulators 412 for the filters that are being controlled. The voltage regulators 412 then control their corresponding variable capacitors (varactors) 411 to tune the notches in the filter system.

In one embodiment, the system 405 utilizes frequency deconfliction bus word definitions. These bus words can specify notch width and center frequency of the notches. In a particular embodiment, 16 bit words can be used to define the notch width, where the ranges is discrete from 122 HZ to 8 MHz. A second 16 bit word may be used to identify the center frequency of the notch. For example, in the low frequency range from 30-600 MHz, a 16 bit word can specify a least significant bit (LSB) of 0.0087 MHz. The system 405 may further implement identification words, that allow more precise control of which filters are used. For example, the identification word may be used to determine which notches are cleared, the center frequencies of the notches, and which notch filter systems are utilized.

In a particular embodiment, the controller 406 comprises an AT91SAM7XC256 from ATMEL. The AT91SAM7XC256 is a flash microcontroller with integrated Ethernet, USB, and CAN interface, and security features, based on the 32-bit ARM7TDMI RISC processor. It features 256 Kbytes of embedded high-speed flash with sector-lock capabilities and a security bit, and 64 Kbytes of SRAM. The integrated proprietary SAM-BA boot assistant enables in-system programming of the embedded flash. This embodiment may achieve a 100 Mbps data rate using the 802.3 Ethernet interface. The AT91SAM7XC256 supports full- and half-duplex operation and has 28-byte transmit FIFO and 28-byte receive FIFO. It also has automatic pad and CRC generation on transmitted frames.

In this embodiment, to achieve a low data rate (up to 10 Mbps), the RS422 standard can be adapted for a USART interface. AT91SAM7XC256 supports 5 to 9 bit full-duplex synchronous or asynchronous serial communications. An SPI/I2C communication interface is also a good option to operate at up to 10 Mbps. USB interfaces are also available for low-data-rate communication with a host PC. The AT91SAM7XC256 supports UBB v2.0 full-speed compliant, 12 Mbits per second, and has six endpoints.

In the illustrated embodiment, the system 405 is equipped with an embedded operating system (OS) to implement its functionality. In a particular embodiment, the embedded OS can be, for example, the Green Hills INTEGRITY real-time OS (RTOS). INTEGRITY supports the use of all ARM processors, as well as PowerPC, XScale, and Blackfin processors. INTEGRITY is useful because it is a secure, royalty-free RTOS intended for use in embedded systems that require maximum reliability. It uses the latest technology and achieves high levels of reliability, availability, and security for applications in military platforms.

In a further embodiment, the control system 405 can use a very highly accurate variable-voltage controller 412. For example, the LP2950 can control voltage up to 29 V. It is CMOS or TTL controllable, has a noise factor of only 0.1 mV, and can change at speeds on the order of 1 μs, which then leads to jitter at the center frequency at 2 GHz of approximately 0.0003 MHz. Based on this, the possible error in notch location will be approximately 10-5% of the commanded frequency.

In a particular embodiment, the notch filters may have operating frequencies from 30 MHz to 1.5 GHz, fractional bandwidths between 1/150 and 1/100000, frequency selectivity of +/−1 kHz, power throughput of 100 W-1 kW, insertion loss >30 dB, and a switching transition of <1 μs.

In some embodiments, the variable capacitors used in the filters may be gap variation MEMS varactor. A gap variation MEMS varactor usually has a movable membrane actuated by one or several electrodes, this is often called a parallel-plate varactor. The relationship between the gap (g) and the voltage (V) when the electrostatic force is equal to the restoring mechanical force is:

$$V = \sqrt{\frac{2k}{\varepsilon_0 \varepsilon A} g^2 (g_0 - g)},$$

where k is the linear spring constant, $\epsilon_0$ is permittivity of a vacuum, $\epsilon$ is permittivity of the dielectric between the plates, A is the area of the plates, and $g_0$ is the initial gap between the membrane and the electrode. As the voltage is increased, the membrane starts deflecting towards the electrode. During this step the electrostatic force and the restoring mechanical force are in equilibrium. This equilibrium exists only if the gap is larger than ⅔ of the initial gap. When the gap gets smaller than ⅔ of the initial gap, the electrostatic force rises faster than the mechanical one, and pull-in occurs and the membrane falls onto the electrode. If only the upper one-third of the gap between the membrane and the electrode is used, then the theoretical tuning ratio is limited to 1.5.

Figure 7:
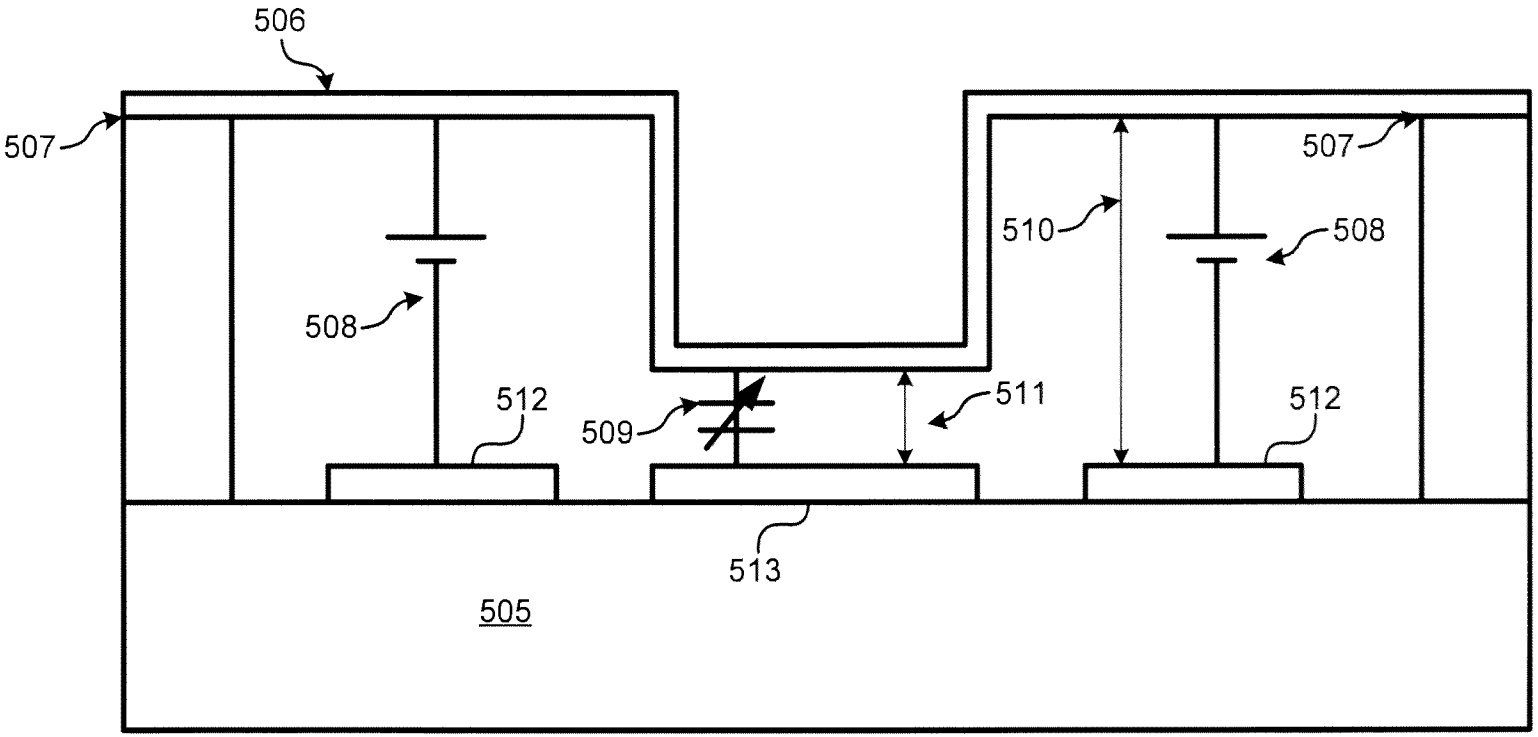
FIG. 7 illustrates a two-level membrane MEMS varactor.

To increase the range, several designs have been developed. FIG. 7 illustrates a two-level membrane used where the central part of the membrane is situated closer to the sensing electrode than the side parts, which are attracted downwards by the electrodes (no voltage 508 is applied to the sensing electrode). In the illustrated MEMS varactor, a membrane 506 is anchored at two points 507 to a substrate 505. The membrane has two levels. A first level is disposed above a sensing electrode 513, separated by a distance or gap 511, determining the variable capacitance 509. Two driving electrodes 512 are disposed below the second portion of membrane 506 and separated by a distance or gap 510. One-third of the larger gap 510, which the membrane 506 can travel without a pull-in, can be made equal to or even larger than the central gap 511. Thus, the center of the membrane 506 can travel the whole gap height 511 without a pull-in.

Figure 8:
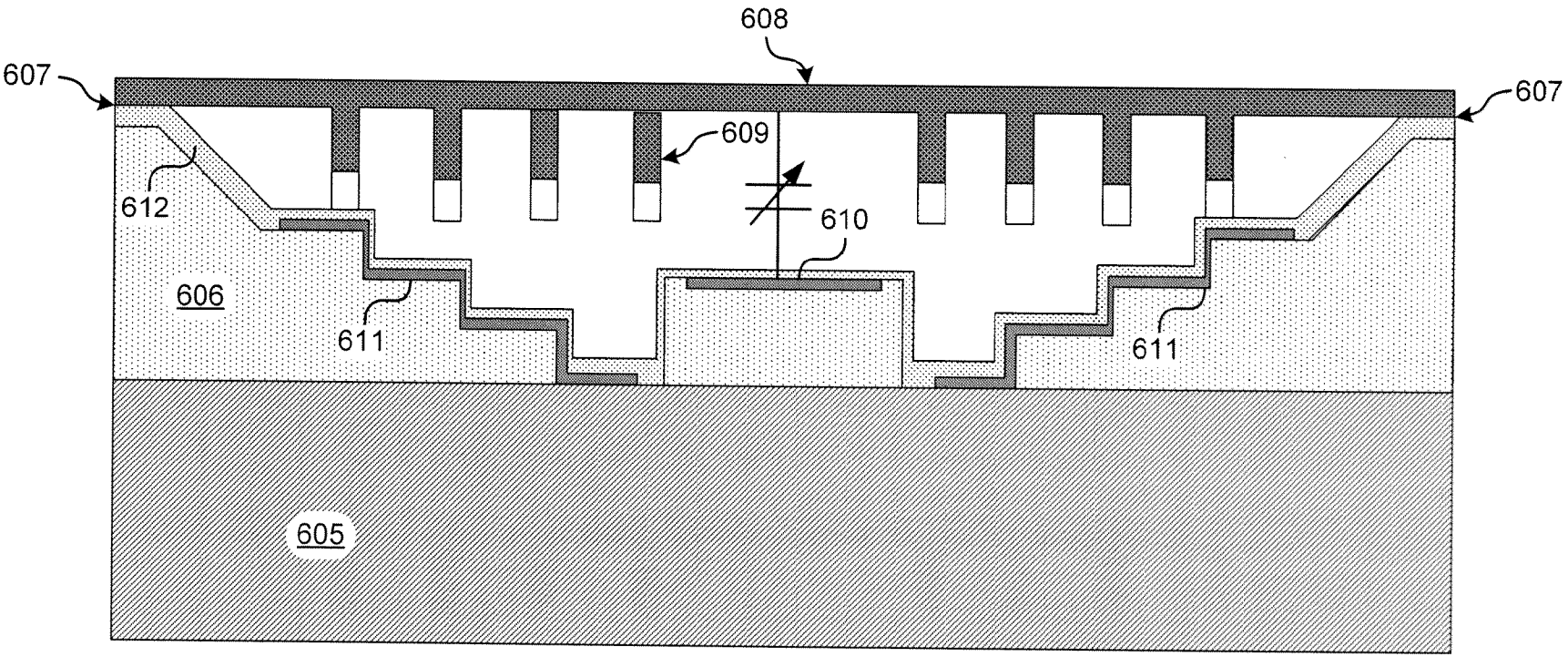
FIG. 8 illustrates an embodiment of a MEMS varactor implemented in accordance with an embodiment of the invention.

FIG. 8 illustrates an embodiment of a MEMS varactor implemented in accordance with an embodiment of the invention. In the illustrated MEMS varactor, a bridge membrane 608 is anchored to a substrate 606 at two points 607. For example, the substrate 606 may comprise a $SiO_2$ substrate disposed over a base glass substrate 605. Two multi-level driving electrodes 611 are disposed on the substrate 606, with different levels displaced from the bridge membrane 608 by different distances. An electrode 610, such as a coplanar waveguide (CPW), acts as a sensing electrode and provides the variable capacitance of the varactor. The electrodes 610 and 611 may be coated in an insulator 612 such as $Si_3N_4$. A step-profile of the electrodes 611 and spacers 609 are used to both increase the capacitance tuning ratio and lower the control voltage. When the control voltage is added and increased between the suspended bridge membrane 608 and the driving electrodes 611, the bridge membrane 608 will be gradually pulled down when the gap between the bridge membrane and the electrode is larger than ⅔ of the initial gap. When the gap gets smaller (reaches ⅔ of the initial gap), the pull-in occurs and, if no spacers 609 were used, the bridge membrane 608 would fall onto the electrodes. The spacers 609 are designed to have a length not less than ⅔ of the gap, so that the bridge membrane 608 is stopped before the pull-in occurs. When a pair of spacers 609 touches the two driving electrodes 611, respectively, the bridge membrane 608 is anchored on the pair of spacers 609. As a result, the length of the bridge membrane 608 becomes shorter (only the bridge membrane between the pair of spacers counts). The shorter bridge membrane 608 requires higher control voltage to pull it down. Increasing the control voltage continues pulling down the bridge membrane 608 and the next pair of spacers 609 touches the driving electrodes 611. In the end, the very central pair of spacers touches the lowest level of the driving electrode and, with a proper design, the bridge touches the CPW's isolation layer, providing the maximum capacitance. With this design, the bridge membrane moveable range is increased from ⅓ of the gap to the entire gap, significantly increasing the capacitance tuning ratio (>30). Meanwhile, each step is kept in a small gap, significantly lowering the control voltage (<5 V). To ensure a high Q and low loss, glass substrate ($\epsilon r$=4.6) will be used to reduce the substrate loss, and the bridge membrane, electrodes, and the CPW can be made with a thick fold layer to reduce the ohmic losses.

Figure 9:
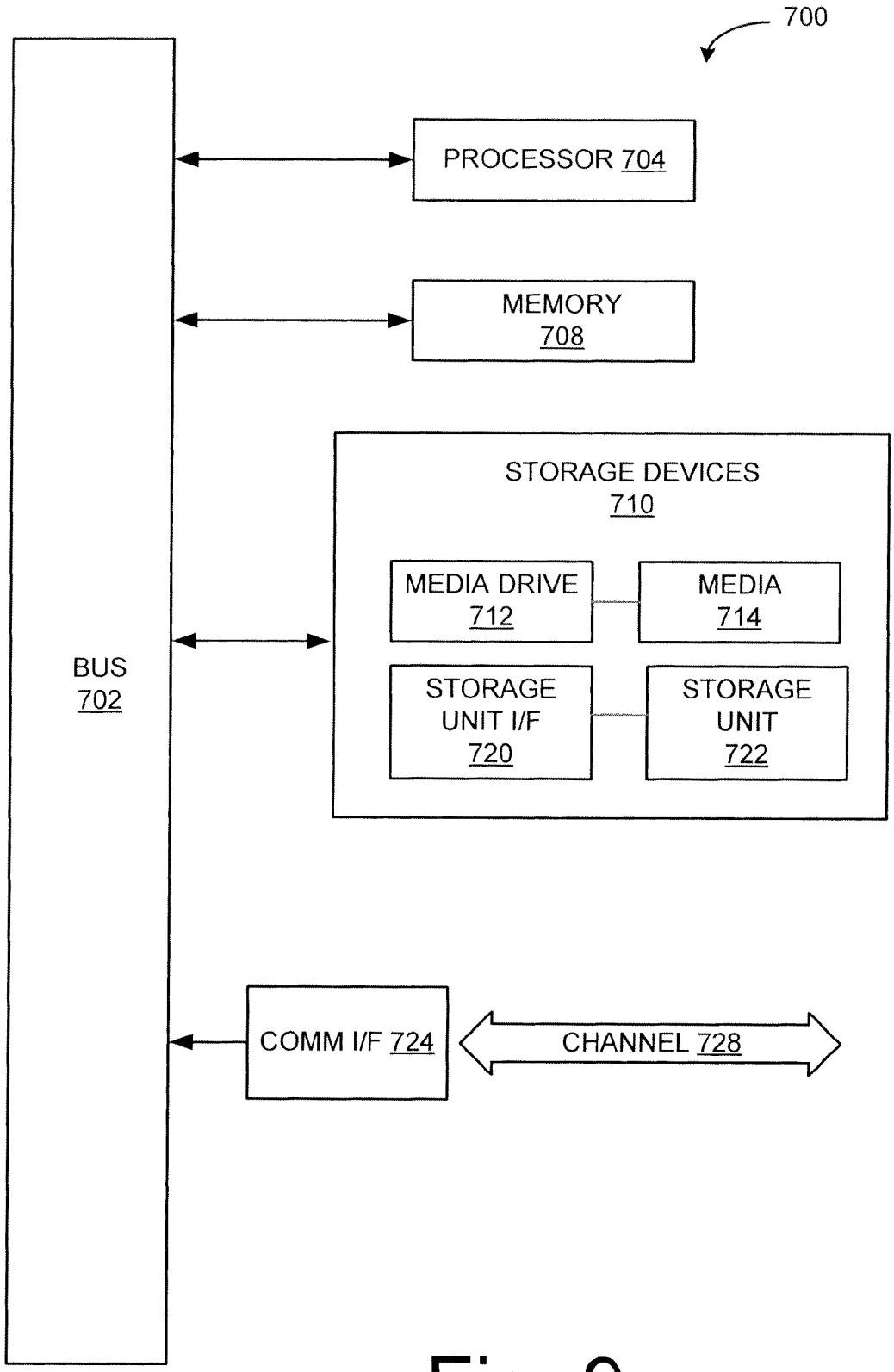
FIG. 9 illustrates an example computing module that may be used in implementing various features of embodiments of the invention.

As used herein, the term module might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 9. Various embodiments are described in terms of this example-computing module 700. After reading this description, it will become apparent to a person skilled in the relevant art how to implement the invention using other computing modules or architectures.

Referring now to FIG. 9, computing module 700 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 700 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 700 might include, for example, one or more processors, controllers, control modules, or other processing devices, such as a processor 704. Processor 704 might be implemented using a general-purpose or special-purpose processing engine such as, for example, a microprocessor, controller, or other control logic. In the illustrated example, processor 704 is connected to a bus 702, although any communication medium can be used to facilitate interaction with other components of computing module 700 or to communicate externally.

Computing module 700 might also include one or more memory modules, simply referred to herein as main memory 708. For example, preferably random access memory (RAM) or other dynamic memory, might be used for storing information and instructions to be executed by processor 704. Main memory 708 might also be used for storing temporary variables or other intermediate information during execution of instructions to be executed by processor 704. Computing module 700 might likewise include a read only memory ("ROM") or other static storage device coupled to bus 702 for storing static information and instructions for processor 704.

The computing module 700 might also include one or more various forms of information storage devices or mechanisms 710, which might include, for example, a media drive 712 and a storage unit interface 720. The media drive 712 might include a drive or other mechanism to support fixed or removable storage media 714. For example, a hard disk drive, a floppy disk drive, a magnetic tape drive, an optical disk drive, a CD or DVD drive (recordable (R) or rewritable (RW)), or other removable or fixed media drive might be provided. Accordingly, storage media 714 might include, for example, a hard disk, a floppy disk, magnetic tape, cartridge, optical disk, a CD or DVD, or other fixed or removable medium that is read by, written to or accessed by media drive 712. As these examples illustrate, the storage media 714 can include a computer usable storage medium having stored therein computer software or data.

In alternative embodiments, information storage mechanism 710 might include other similar instrumentalities for allowing computer programs or other instructions or data to be loaded into computing module 700. Such instrumentalities might include, for example, a fixed or removable storage unit 722 and an interface 720. Examples of such storage units 722 and interfaces 720 can include a program cartridge and cartridge interface, a removable memory (for example, a flash memory or other removable memory module) and memory slot, a PCMCIA slot and card, and other fixed or removable storage units 722 and interfaces 720 that allow software and data to be transferred from the storage unit 722 to computing module 700.

Computing module 700 might also include a communications interface (COMM I/F) 724. Communications interface 724 might be used to allow software and data to be transferred between computing module 700 and external devices. Examples of communications interface 724 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 724 might typically be carried on signals, which can be electronic, electromagnetic (which includes optical) or other signals capable of being exchanged by a given communications interface 724. These signals might be provided to communication interface 724 via a channel 728. This channel 728 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 708, storage unit 720, media 714, and channel 728. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 700 to perform features or functions of the present invention as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A tunable notch filter, comprising:

a transmission line coupled to an antenna;

a plurality of ring resonators inductively coupled to the transmission line, wherein each ring resonator of the plurality of ring resonators is grounded and composes a respective variable microelectromechanical systems (MEMS) capacitor;

wherein a set of the variable MEMS capacitors of the plurality of ring resonators are independently tunable to vary a notch location and a notch width of the tunable notch filter; and wherein each ring resonator of a set of ring resonators of the plurality of ring resonators further comprises a respective attenuator configured to reduce power reflected from the antenna.

2. The tunable notch filter of claim 1, wherein the set of ring resonators is the entirety of the plurality of ring resonators and the respective attenuators of each ring resonator of the set of ring resonators comprise a corresponding pi-pad attenuator.

3. The tunable notch filter of claim 2, wherein the transmission line and the plurality of ring resonators are superconducting.

4. The tunable notch filter of claim 3, wherein the superconducting transmission line and the plurality of superconducting ring resonators comprise yttrium barium copper oxide (YBCO).

5. The tunable notch filter of claim 1, wherein the one or more ring resonators of the plurality of ring resonators comprises a respective radial ring resonator.

6. The tunable notch filter of claim 1, wherein one or more ring resonators of the plurality of ring resonators further comprises a respective PIN diode configured to switchably control activation of the corresponding ring resonator.

7. The tunable notch filter of claim 1, wherein the distance between each ring resonator of the plurality of ring resonators and the transmission line varies such that power is balanced between each ring resonator of the plurality of ring resonators.

8. The tunable notch filter of claim 1, wherein the set of ring resonators is the entirety of the plurality of ring resonators.

9. The tunable notch filter of claim 1, wherein the at least one variable MEMS capacitor of the plurality of ring resonators comprise:

a movable conductive bridge coupled to a substrate;

a driving electrode coupled to the substrate, the driving electrode having a plurality of portions located at varying distances from the bridge when the bridge is an initial position, with each portion being parallel to the bridge;

a waveguide coupled to the substrate parallel to the bridge and located at a predetermined distance from the bridge when the bridge is in the initial position; and a plurality of spacers coupled to the movable conductive bridge, wherein each spacer of the plurality of spacers is configured to contact a corresponding electrode portion of the driving electrode when a sufficient control voltage is applied to the electrode and the bridge.

10. A filter system, comprising a system interface;

a control unit coupled to the system interlace; and a notch filter coupled to the control unit, a jamming source, and an antenna;

wherein the notch filter comprises:

a transmission line coupled to the antenna;

a plurality of ring resonators inductively coupled to the transmission line, wherein each ring resonator of the plurality of ring resonators is grounded and comprises a respective variable microelectromechanical systems (MEMS) capacitor;

wherein a set of the variable MEMS capacitors of the plurality of ring resonators are independently tunable to vary a notch location and a notch width of the tunable notch filter; and wherein each ring resonator of a set of ring resonators of the plurality of ring resonators further comprises a respective attenuator configured to reduce power reflected from the antenna.

11. The filter system of claim 10, wherein the notch filter is one of a plurality of notch filters.

12. The filter system of claim 11, wherein each ring resonator is independently tunable to notch out power in a specific frequency band.

13. The filter system of claim 11, wherein each ring resonator is independently tunable to notch out power in a plurality of frequency bands.

14. The filter system of claim 10, wherein the plurality of ring resonators are housed in a housing and wherein the plurality of ring resonators are connected in series; and further comprising a plurality of metal walls separating adjacent ones of the plurality of ring resonators.

15. The filter system of claim 10, wherein the set of ring resonators is the entirety of the plurality of ring resonators and the respective attenuator of each ring resonator of the set of ring resonators comprise a corresponding pi-pad attenuator.

16. The filter system of claim 10, wherein the transmission line and the plurality of ring resonators are superconducting.

17. The filter system of claim 16, wherein the superconducting transmission line and the plurality of superconducting ring resonators comprise yttrium barium copper oxide (YBCO).

18. The filter system of claim 10, wherein one or more ring resonators of the plurality of ring resonators comprises a respective radial ring resonator.

19. The filter system of claim 10, wherein one or more ring resonators of the plurality of ring resonators further comprises a respective PIN diode coupled to the control unit and configured to switchably control activation of the one or more ring resonators of the plurality of ring resonators.

20. The filter system of claim 10, further comprising a feedback circuit that couples the notch filter to the control unit, the feedback circuit being configured to allow the control unit to monitor a notch location of the notch filter for notch location errors, which the control unit may use to adjust the notch location to maintain the notch location within a predetermined range.

* * * * *